US009311870B2

(12) United States Patent
Hsiao

(10) Patent No.: US 9,311,870 B2
(45) Date of Patent: Apr. 12, 2016

(54) DRIVING APPARATUS AND DISPLAY PANEL

(75) Inventor: Chu-Ya Hsiao, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 158 days.

(21) Appl. No.: 13/008,019

(22) Filed: Jan. 18, 2011

(65) Prior Publication Data

US 2012/0133629 A1 May 31, 2012

(30) Foreign Application Priority Data

Nov. 26, 2010 (TW) ..... 99141047 A

(51) Int. Cl.
*G09G 3/36* (2006.01)

(52) U.S. Cl.
CPC ..... *G09G 3/3614* (2013.01); *G09G 3/3688* (2013.01); *G09G 2300/0426* (2013.01); *G09G 2310/0218* (2013.01); *G09G 2330/021* (2013.01)

(58) Field of Classification Search
USPC ..... 345/87, 89, 204, 209
See application file for complete search history.

(56) References Cited

U.S. PATENT DOCUMENTS

| | | | | |
|---|---|---|---|---|
| 5,604,511 | A * | 2/1997 | Ohi | 345/98 |
| 5,748,165 | A * | 5/1998 | Kubota et al. | 345/96 |
| 6,075,505 | A | 6/2000 | Shiba et al. | |
| 6,424,328 | B1 | 7/2002 | Ino et al. | |
| 6,707,441 | B1 * | 3/2004 | Hebiguchi et al. | 345/92 |
| 2004/0178980 | A1 * | 9/2004 | Rao et al. | 345/96 |
| 2004/0179014 | A1 * | 9/2004 | Nakano et al. | 345/501 |
| 2006/0103618 | A1 * | 5/2006 | Miura | 345/96 |
| 2010/0265238 | A1 * | 10/2010 | Lee et al. | 345/211 |

FOREIGN PATENT DOCUMENTS

| | | |
|---|---|---|
| CN | 1115535 | 1/1996 |
| CN | 1112797 | 6/2003 |
| CN | 1525217 | 9/2004 |
| CN | 1773600 | 5/2006 |
| CN | 101471042 | 7/2009 |
| CN | 100527209 | 8/2009 |
| TW | 200417777 | 9/2004 |
| TW | 201025266 | 7/2010 |

OTHER PUBLICATIONS

"Office Action of Taiwan Counterpart Application", issued on Aug. 27, 2013, p. 1-p. 7, in which the listed references were cited.
"First Office Action of China Counterpart Application", issued on Dec. 13, 2013, p. 1-p. 7, in which the listed references were cited.

* cited by examiner

*Primary Examiner* — Calvin C Ma
(74) *Attorney, Agent, or Firm* — Jianq Chyun IP Office

(57) ABSTRACT

A driving apparatus and a display panel are provided. The display panel includes M*2N pixels, N data driving units, 2M scan lines and 2N data lines. The M*2N pixels are arranged as an M*2N matrix. M and N are positive integers. Each scan line is electrically coupled to N pixels in the same row. Each data driving unit is electrically coupled to two data lines that are not adjacent to each other.

16 Claims, 5 Drawing Sheets

DRIVING APPARATUS AND DISPLAY PANEL

CROSS-REFERENCE TO RELATED APPLICATION

This application claims the priority benefit of Taiwan application serial no. 99141047, filed on Nov. 26, 2010. The entirety of the above-mentioned patent application is hereby incorporated by reference herein and made a part of this specification.

BACKGROUND

1. Field of the Invention

The invention relates to a display panel. Particularly, the invention relates to a display panel capable of achieving a dot inversion display effect.

2. Description of Related Art

A thin film transistor liquid crystal display (TFT LCD) has a slower response speed in animation performance due to a physical phenomena of the liquid crystal compared to a conventional picture tube. In order to mitigate a motion blur phenomenon, an impulse type display technique is used to mitigate the motion blur phenomenon through a black insertion method, which simulates a solution similar to a working principle of the conventional picture tube, and a frame rate or a refresh rate is increased to shorten a (visual) integration time, so as to reduce a blur edge. Moreover, under a development trend that a double frame rate (120 Hz) is commonly used, a current structure design may have some problems, for example, a time length of a horizontal line of each row is reduced by a half, so that a problem of insufficient charging time is occurred especially in case of a high resolution. Moreover, in case of the double frame rate, a dot inversion driving method is used considering optimal driving of a display panel, so that a toggle rate of positive and negative outputs of a source driver is doubled, and a total power consumption of the system is increased by multiples, so that a thermal problem is encountered, which may directly influence reliability of the system.

FIG. 1 is a schematic diagram of a conventional display panel. Referring to FIG. 1, each data line 110 of the display panel 100 is connected to pixels 120 of two columns, so as to reduce a number of data driving units (not shown) used for providing data signals. However, in order to achieve the dot inversion display effect, a number of the scan lines 130 is doubled. When the first scan line 130 is turned on, all of the data lines 110 can write data signals of a positive polarity into even pixels 120 in a first row. When the second scan line 130 is turned on, all of the data lines 110 can write data signals of a negative polarity into odd pixels 120 in the first row. In this way, the dot inversion display effect is achieved. However, the data lines 110 have to provide data signals with different polarities in adjacent timings, which may still cause increasing of the total power consumption of the system.

SUMMARY OF THE INVENTION

The invention is directed to a display panel, which can resolve a problem that total power consumption is increased along with a dot inversion display effect.

The invention is directed to a driving apparatus, which can drive a display panel to resolve a problem that total power consumption is increased along with a dot inversion display effect.

The invention provides a display panel including M*2N pixels, N data driving units, 2M scan lines and 2N data lines.

The M*2N pixels are arranged as an M*2N matrix. M and N are positive integers. Each of the scan lines is electrically coupled to N pixels in the same row. Each of the data driving units is electrically coupled to two of the data lines that are not adjacent to each other.

The invention provides a driving apparatus, which is adapted to drive M*2N pixels on a display panel, where M and N are positive integers. The driving apparatus includes N data driving units and 2N data lines. Each of the data driving units is electrically coupled to two of the data lines that are not adjacent to each other.

In an embodiment of the invention, in a same timing, polarities of signals provided by any two of the data driving units adjacent to each other are inversed, and polarities of signals received by any two of the pixels adjacent to each other are inversed.

In an embodiment of the invention, the data driving units are operational amplifiers.

In an embodiment of the invention, the display panel further includes a plurality of switches disposed between the data driving units and the data lines for determining the data lines where output signals of the data driving units to be output to.

In an embodiment of the invention, the data driving units and the switches are integrated in at least one driving chip.

According to the above descriptions, in the driving apparatus and the display panel of the invention, each of the data driving units is electrically coupled to two data lines that are not adjacent to each other. Therefore, each of the data driving unit can transmit the data signals of the same polarity to achieve the dot inversion display effect.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
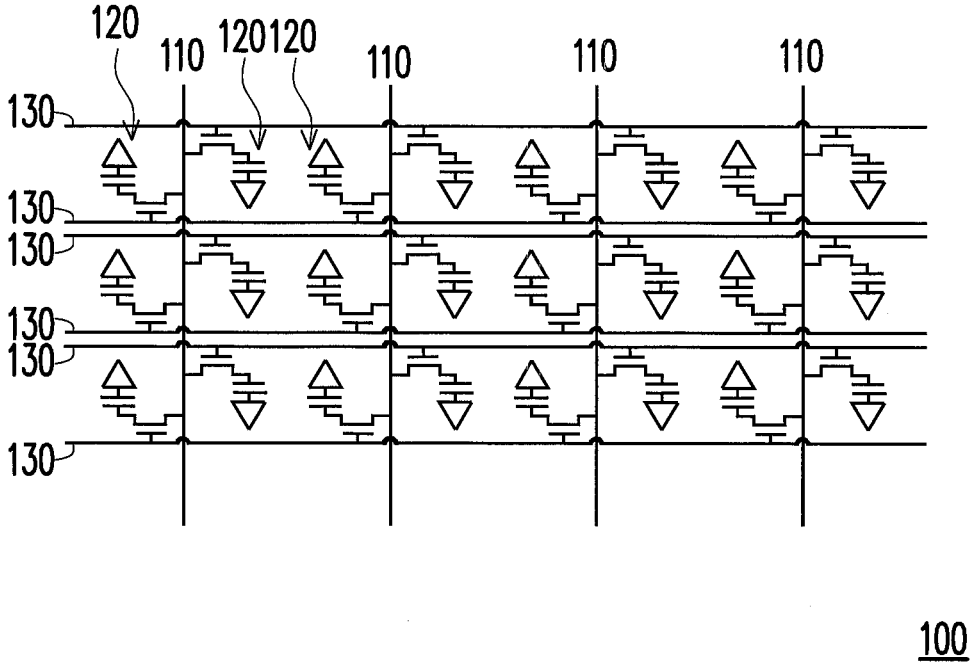
FIG. 1 (RELATED ART)
FIG. 1 is a schematic diagram of a conventional display panel.
Figure 2:
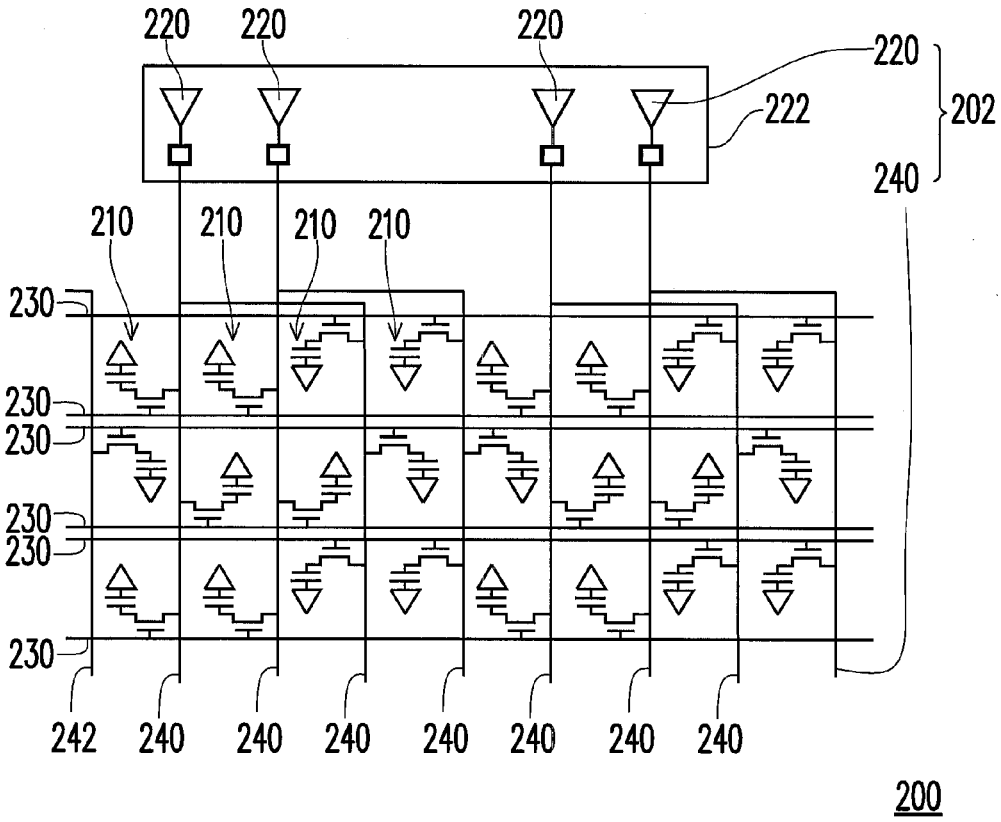
FIG. 2 is a schematic diagram of a display panel and a driving apparatus according to an embodiment of the invention.

FIG. 2 is a schematic diagram of a display panel and a driving apparatus according to an embodiment of the invention. Referring to FIG. 2, the display panel 200 of the present embodiment includes M*2N pixels 210, N data driving units 220, 2M scan lines 230 and 2N data lines 240. The N data driving units 220 and 2N data lines 240 form a driving apparatus 202 of the present embodiment. The M*2N pixels 210 are arranged as an M*2N matrix, i.e. pixels 210 of M rows, where each row has 2N pixels 210 arranged along a horizontal direction, and M and N are positive integers. Each of the scan lines 230 is electrically coupled to N pixels 210 in the same row. Namely, only a half of the 2N pixels 210 of each row is electrically coupled to the same scan line 230. Each of the data lines 240 is electrically coupled to even pixels 210 or odd pixels 210 of a same column. For example, the first data line 240 is electrically coupled to odd pixels 210 of a first column and even pixels 210 of a second column, and the second data line 240 is electrically coupled to odd pixels 210 of the second column and even pixels 210 of a third column. Each of the data driving units 220 is electrically coupled to two data lines 240 that are not adjacent to each other. For example, the first data driving unit 220 is electrically coupled to the first and the third data lines 240, the second data driving unit 220 is electrically coupled to the second and the fourth data lines 240, and the third data driving unit 220 is electrically coupled to the fifth and the seventh data lines 240. The two non-adjacent data lines 240 electrically coupled to each of the data driving units 220 can also be electrically coupled at another end of the display panel 200, which are all the same throughout FIG. 2 to FIG. 7, so that detailed structures thereof are not illustrated.

Taking FIG. 2 as an example, when the display panel 200 is driven, in a first timing, the first scan line 230 activates the pixels 210 of the $3^{rd}$, $4^{th}$, $7^{th}$ and $8^{th}$ columns of the $1^{st}$ row, and the first data driving unit 220 transmits a data signal with a positive polarity to the pixel 210 of the $3^{rd}$ column of the $1^{st}$ row through the third data line 240, the second data driving unit 220 transmits a data signal with a negative polarity to the pixel 210 of the $4^{th}$ column of the $1^{st}$ row through the fourth data line 240, the third data driving unit 220 transmits a data signal with the positive polarity to the pixel 210 of the $7^{th}$ column of the $1^{st}$ row through the seventh data line 240, and the fourth data driving unit 220 transmits a data signal with the negative polarity to the pixel 210 of the $8^{th}$ column of the $1^{st}$ row through the eight data line 240. In a second timing, the second scan line 230 activates the pixels 210 of the $1^{st}$, $2^{nd}$, $5^{th}$ and $6^{th}$ columns of the $1^{st}$ row, and the first data driving unit 220 transmits a data signal of the positive polarity to the pixel 210 of the $1^{st}$ column of the $1^{st}$ row through the first data line 240, the second data driving unit 220 transmits a data signal with the negative polarity to the pixel 210 of the $2^{nd}$ column of the $1^{st}$ row through the second data line 240, the third data driving unit 220 transmits a data signal with the positive polarity to the pixel 210 of the $5^{th}$ column of the $1^{st}$ row through the fifth data line 240, and the fourth data driving unit 220 transmits a data signal with the negative polarity to the pixel 210 of the $6^{th}$ column of the $1^{st}$ row through the sixth data line 240. Deduced by analogy, after all of the pixels 210 receives the data signals, a distribution of the data signals of the pixels 210 of the whole display panel 200 may have a dot inversion display effect, i.e. the polarity of the data signal of each pixel 210 is inversed to the polarity of the data signal of the adjacent pixel 210, so that a better display quality is achieved.

Moreover, during a process of refreshing a whole frame of the display panel 200, the first and the third data driving units 220 only transmit data signals of the positive polarity, and the second and the fourth data driving units 220 only transmit data signals of the negative polarity. In other words, the data lines 240 electrically connected to the data driving units 220 are column inversion, so that a power consumption of the data driving units 220 can be reduced. Certainly, during a next process of refreshing the whole frame, the polarity of the data signal transmitted by each of the data driving units 220 can be the same or inversed to the polarity of the data signal transmitted during the previous process of refreshing the whole frame.

In the present embodiment, each of the data driving units 220 includes an operational amplifier, though the data driving unit 220 may also include other components. Since one data driving unit 220 is electrically coupled to two data lines 240, each time when each of the data driving units 220 sends a data signal, the two data lines 240 connected thereto may receive the same data signal, and whether the data signal is transmitted to the connected pixel 210 is determined by whether the scan line 230 connected to the pixel 210 transmits an activating signal. Moreover, the data driving units 220 can be integrated in a plurality of driving chips 222, and each of the driving chips 222 may include a plurality of the data driving units 220, though only one driving chip 222 is illustrated in FIG. 2. According to FIG. 2, it is known that the second and the third data lines 240 can be intersected, and an intersection thereof can be designed on a substrate (not shown) of the display panel 200, and can also be designed on a driving circuit board (not shown). Moreover, according to a structure design of FIG. 2, another data line 242 and another data driving unit (not shown) are used to transmit the data signal to the even pixels 210 of the first column, such obvious and necessary design is not described in detail herein, and the data line 242 is not counted in the aforementioned descriptions.

In FIG. 2, the pixels 210 of the $3^{rd}$ and $4^{th}$ columns of the $1^{st}$ row are electrically coupled to the first scan line 230, the pixels 210 of the $1^{st}$ and $2^{nd}$ columns of the $1^{st}$ row are electrically coupled to the second scan line 230, and every four of the subsequent pixels 210 of the $1^{st}$ row repeat the electrical couplings with the scan lines 230 according to the above rule. Similarly, the pixels 210 of the $1^{st}$ and $4^{th}$ columns of the $2^{nd}$ row are electrically coupled to the third scan line 230, the pixels 210 of the $2^{nd}$ and $3^{rd}$ columns of the $2^{nd}$ row are electrically coupled to the fourth scan line 230, and every four of the subsequent pixels 210 of the $2^{nd}$ row repeat the electrical couplings with the scan lines 230 according to the above rule. Variations of electrical coupling method of the pixels and the scan lines of the display panel are described below according to a plurality of embodiments of the invention with reference of figures.

Figure 3:
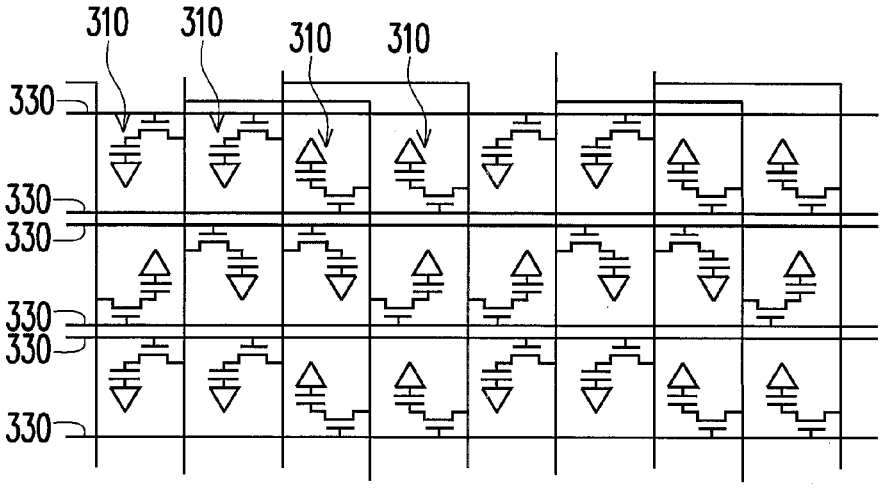
FIGS. 3-7 are schematic diagrams of display panels according to other five embodiments of the invention.

Referring to FIG. 3, pixels 310 of the $1^{st}$ and $2^{nd}$ columns of the $1^{st}$ row are electrically coupled to a first scan line 330, the pixels 310 of the $3^{rd}$ and $4^{th}$ columns of the $1^{st}$ row are electrically coupled to the second scan line 330, and every four of the subsequent pixels 310 of the $1^{st}$ row repeat the electrical couplings with the scan lines 330 according to the above rule. Similarly, the pixels 310 of the $2^{nd}$ and $3^{rd}$ columns of the $2^{nd}$ row are electrically coupled to the third scan line 330, the pixels 310 of the $1^{st}$ and $4^{th}$ columns of the $2^{nd}$ row are electrically coupled to the fourth scan line 330, and every four of the subsequent pixels 310 of the $2^{nd}$ row repeat the electrical couplings with the scan lines 330 according to the above rule.

Figure 4:
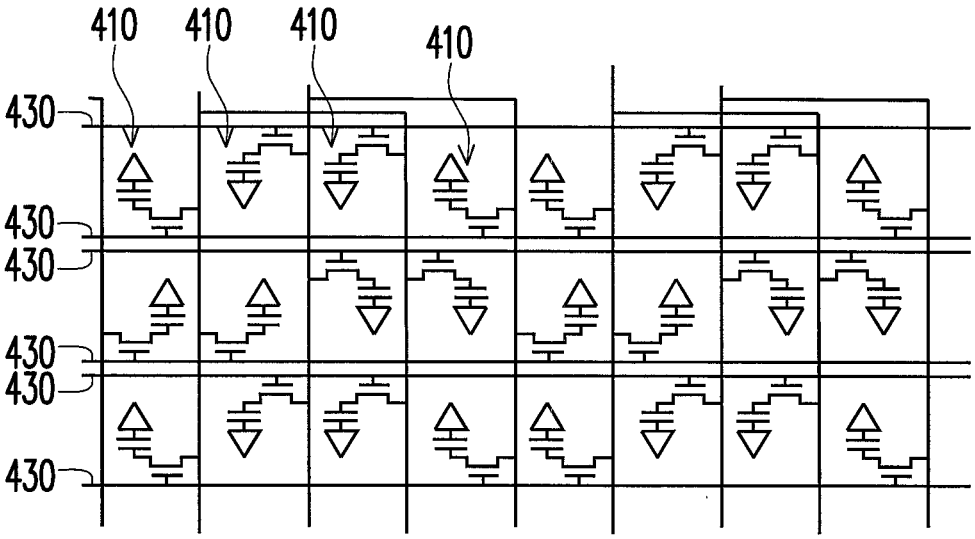

Referring to FIG. 4, pixels 410 of the $2^{nd}$ and $3^{rd}$ columns of the $1^{st}$ row are electrically coupled to a first scan line 430, the pixels 410 of the $1^{st}$ and $4^{th}$ columns of the $1^{st}$ row are electrically coupled to the second scan line 430, and every four of the subsequent pixels 410 of the $1^{st}$ row repeat the electrical couplings with the scan lines 430 according to the above rule. Similarly, the pixels 410 of the $3^{rd}$ and $4^{th}$ columns of the $2^{nd}$ row are electrically coupled to the third scan line 430, the pixels 410 of the $1^{st}$ and $2^{nd}$ columns of the $2^{nd}$ row are electrically coupled to the fourth scan line 430, and every four of the subsequent pixels 410 of the $2^{nd}$ row repeat the electrical couplings with the scan lines 430 according to the above rule.

Figure 5:
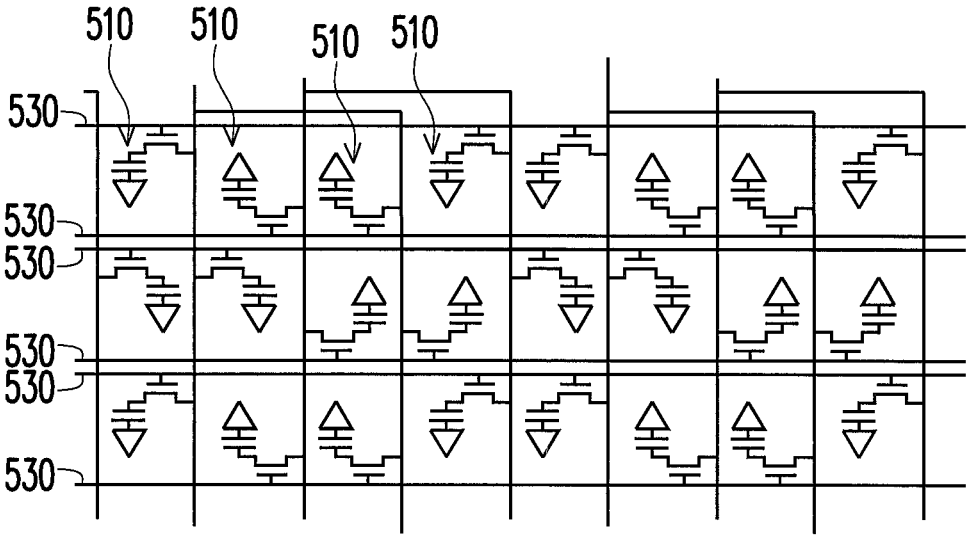

Referring to FIG. 5, pixels 510 of the $1^{st}$ and $4^{th}$ columns of the $1^{st}$ row are electrically coupled to a first scan line 530, the pixels 510 of the $2^{nd}$ and $3^{rd}$ columns of the $1^{st}$ row are electrically coupled to the second scan line 530, and every four of the subsequent pixels 510 of the $1^{st}$ row repeat the electrical couplings with the scan lines 530 according to the above rule. Similarly, the pixels 510 of the $1^{st}$ and $2^{nd}$ columns of the $2^{nd}$ row are electrically coupled to the third scan line 530, the pixels 510 of the $3^{rd}$ and $4^{th}$ columns of the $2^{nd}$ row are electrically coupled to the fourth scan line 530, and every four of the subsequent pixels 510 of the $2^{nd}$ row repeat the electrical couplings with the scan lines 530 according to the above rule.

Figure 6:
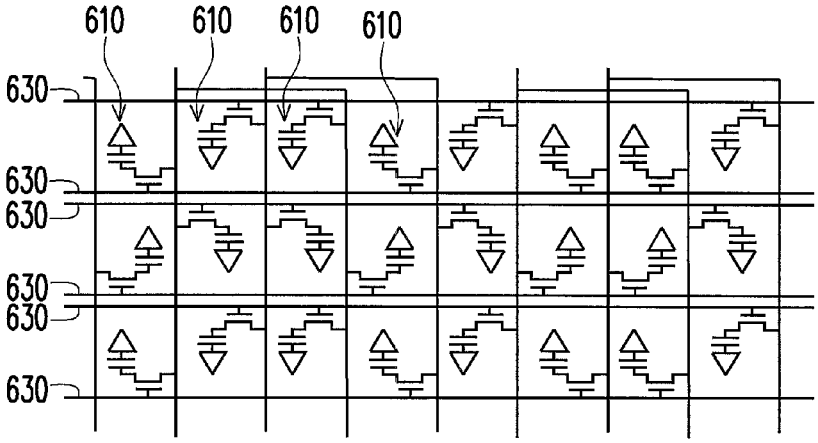

Referring to FIG. 6, pixels 610 of the $2^{nd}$, $3^{rd}$, $5^{th}$ and $8^{th}$ columns of the $1^{st}$ and row are electrically coupled to a first scan line 630, the pixels 610 of the $1^{st}$, $4^{th}$, $6^{th}$ and $7^{th}$ columns of the $1^{st}$ row are electrically coupled to the second scan line 630, and every eight of the subsequent pixels 610 of the $1^{st}$ row repeat the electrical couplings with the scan lines 630 according to the above rule. Similarly, the pixels 610 of the $2^{nd}$, $3^{rd}$, $5^{th}$ and $8^{th}$ columns of the $2^{nd}$ row are electrically coupled to the third scan line 630, the pixels 610 of the $1^{st}$, $4^{th}$, $6^{th}$ and $7^{th}$/columns of the $2^{nd}$ row are electrically coupled to the fourth scan line 630, and every eight of the subsequent pixels 610 of the $2^{nd}$ row repeat the electrical couplings with the scan lines 630 according to the above rule. In brief, in FIG. 6, the repeated units (every four pixels) of FIG. 2 to FIG. 5 are rearranged along a horizontal direction, so as to achieve the repeat feature of every eight pixels, so that the other arrangements and combinations of the pixels with the same repeat feature are not described.

Figure 7:
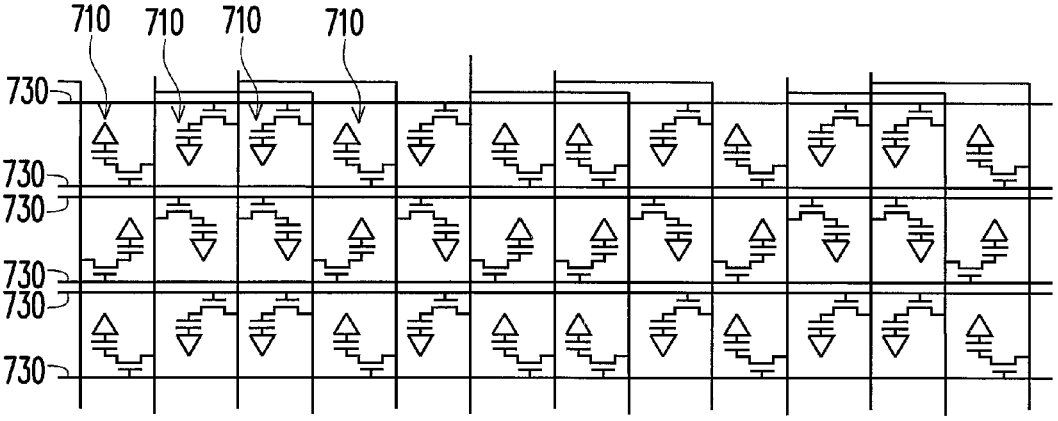

Referring to FIG. 7, pixels 710 of the $2^{nd}$, $3^{rd}$, $5^{th}$, $8^{th}$, $10^{th}$ and $11^{th}$ columns of the $1^{st}$ row are electrically coupled to a first scan line 730, the pixels 710 of the $1^{st}$, $4^{th}$, $6^{th}$, $7^{th}$, $9^{th}$ and $12^{th}$ columns of the $1^{st}$ row are electrically coupled to the second scan line 730, and every twelve of the subsequent pixels 710 of the $1^{st}$ row repeat the electrical couplings with the scan lines 730 according to the above rule. Similarly, the pixels 710 of the $2^{nd}$, $3^{rd}$, $5^{th}$, $8^{th}$, $10^{th}$ and $11^{th}$ columns of the $2^{nd}$ row are electrically coupled to the third scan line 730, the pixels 710 of the $1^{st}$, $4^{th}$, $6^{th}$, $7^{th}$, $9^{th}$ and $12^{th}$ columns of the $2^{nd}$ row are electrically coupled to the fourth scan line 730, and every twelve of the subsequent pixels 710 of the $2^{nd}$ row repeat the electrical couplings with the scan lines 730 according to the above rule. In brief, in FIG. 7, the repeated units (every four pixels) of FIG. 2 to FIG. 5 are rearranged along the horizontal direction, so as to achieve the repeat feature of every twelve pixels, so that the other arrangements and combinations of the pixels with the same repeat feature are not described. According to the description of the embodiments of FIG. 6 and FIG. 7, combinations of the similar arrangement method used to achieve the repeat features of every 16, 20, 24, 28, 32, . . . pixels are not described.

Figure 8:
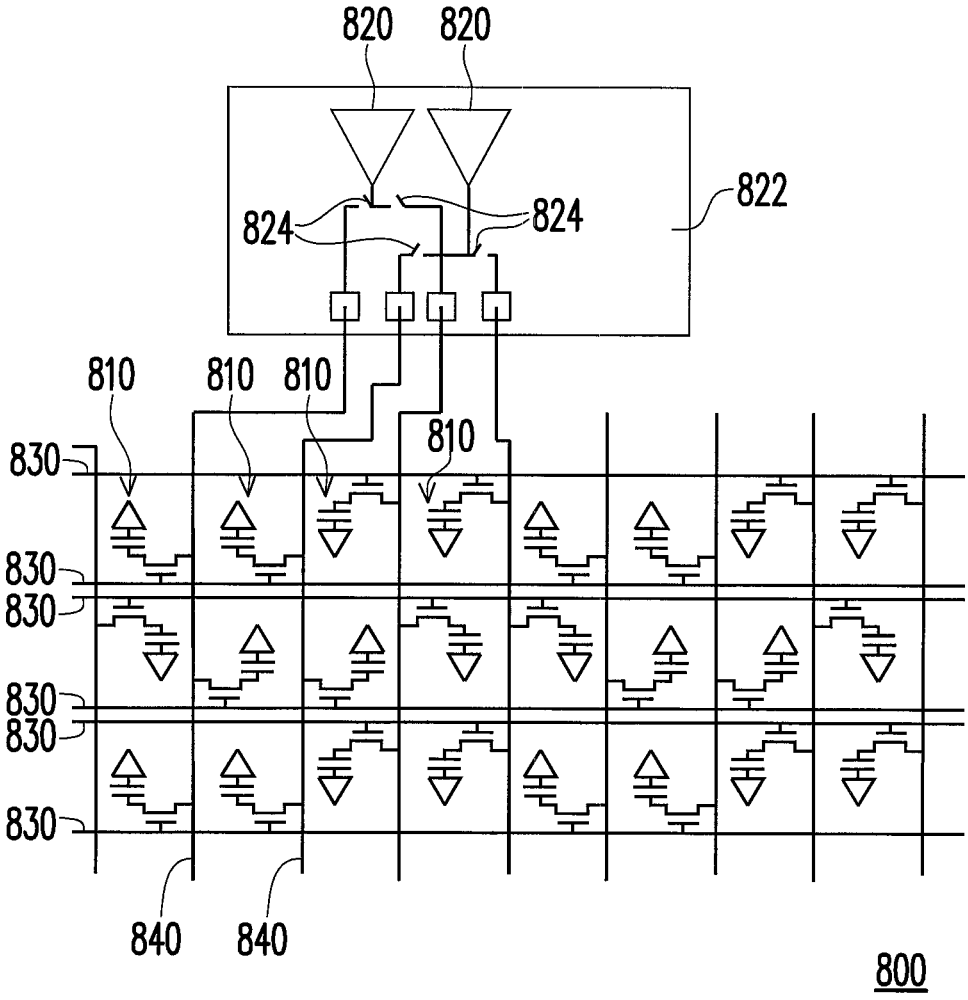
FIG. 8 is a schematic diagram of a display panel according to another embodiment of the invention.

FIG. 8 is a schematic diagram of a display panel according to another embodiment of the invention. Referring to FIG. 8, the display panel 800 of the present embodiment is similar to the display panel 200 of FIG. 2, and only differences there between are described below. The display panel 800 further includes a plurality of switches 824, which are disposed between data driving units 820 and data lines 840 for determining the data lines 840 where the output signals of the data driving units 820 to be output to. The data driving units 820 and the switches 824 can be integrated in at least one driving chip 822. Moreover, besides integrated in the driving chip 822, the switches 824 can also be directly fabricated on the display panel 800.

When the display panel 800 of the present embodiment is driven, in a first timing, a first scan line 830 activates pixels 810 of the $3^{rd}$, $4^{th}$, $7^{th}$ and $8^{th}$ columns of the $1^{st}$ row, the switch 824 between the first data driving unit 820 and the first data line 840 is turned off, and the switch 824 between the first data driving unit 820 and the third data line 840 is turned on. Therefore, the first data driving unit 820 transmits a data signal with the positive polarity to the pixel 810 of the $3^{rd}$ column of the $1^{st}$ row through the third data line 840, though the first data driving unit 820 does not transmit any data signal through the first data line 840. Similarly, the switch 824 between the second data driving unit 820 and the second data line 840 is turned off, and the switch 824 between the second data driving unit 820 and the fourth data line 840 is turned on. Therefore, the second data driving unit 820 transmits a data signal with the negative polarity to the pixel 810 of the $4^{th}$ column of the $1^{st}$ row through the fourth data line 840, though the second data driving unit 820 does not transmit any data signal through the second data line 840.

In a second timing, the second scan line 830 activates the pixels 810 of the $1^{st}$, $2^{nd}$, $5^{th}$ and $6^{th}$ columns of the $1^{st}$ row, the switch 824 between the first data driving unit 820 and the first data line 840 is turned on, and the switch 824 between the first data driving unit 820 and the third data line 840 is turned off. Therefore, the first data driving unit 820 transmits a data signal with the positive polarity to the pixel 810 of the $1^{st}$ column of the $1^{st}$ row through the first data line 840, though the first data driving unit 820 does not transmit any data signal through the third data line 840. Similarly, the switch 824 between the second data driving unit 820 and the second data line 840 is turned on, and the switch 824 between the second data driving unit 820 and the fourth data line 840 is turned off. Therefore, the second data driving unit 820 transmits a data signal with the negative polarity to the pixel 810 of the $2^{nd}$ column of the $1^{st}$ row through the second data line 840, though the second data driving unit 820 does not transmit any data signal through the fourth data line 840. In other words, by switching the switches 824, one of the data driving units 820 is conducted to only one of the data lines 840 during each timing, so that each time each of the data driving units 820 only sends a data signal to one of the data lines 840. In this way, the power consumption of the data driving units 820 can be further reduced.

In summary, in the display panel of the invention, each of the data driving units is electrically coupled to two data lines that are not adjacent to each other. Therefore, each of the data driving unit can transmit the data signals of the same polarity, so that the data lines are column inversion, though all of the pixels of the whole display panel may have a dot inversion display effect.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A display panel, comprising:

M*2N pixels, arranged as an M*2N matrix, wherein M and N are positive integers;

N data driving units;

2M scan lines, each of the scan lines being electrically coupled to N pixels in the same row; and 2N data lines, each of the data lines being electrically coupled to pixels arranged in a plurality of odd rows of a column adjacent to one side of the each of the data lines and a plurality of even rows of another column adjacent to another side of the each of the data lines, wherein only one column of pixels are located between adjacent data lines, and the pixels arranged in the same column are alternately electrically coupled to opposite data lines of the adjacent data lines, wherein each of the data driving units is electrically coupled to two of the data lines that are not adjacent to each other.

2. The display panel as claimed in claim 1, wherein the data driving units are operational amplifiers.

3. The display panel as claimed in claim 1, further comprising a plurality of switches disposed between the data driving units and the data lines for determining the data lines where output signals of the data driving units to be output to.

4. The display panel as claimed in claim 3, wherein the data driving units and the switches are integrated in at least one driving chip.

5. The display panel as claimed in claim 1, wherein two of the scan lines are disposed between any two adjacent row of the pixels.

6. The display panel as claimed in claim 1, wherein each of the data driving units is electrically coupled to two of the data lines that are alternate with one of the data lines electrically coupled to a neighboring one of the data driving units.

7. A driving apparatus, adapted to drive M*2N pixels on a display panel, wherein M and N are positive integers, and the driving apparatus comprising:

N data driving units; and 2N data lines, each of the data lines being electrically coupled to pixels arranged in a plurality of odd rows of a column adjacent to one side of the each of the data lines and a plurality of even rows of another column adjacent to another side of the each of the data lines, wherein only one column of pixels are located between adjacent data lines, and the pixels arranged in the same column are alternately electrically coupled to opposite data lines of the adjacent data lines, wherein each of the data driving units is electrically coupled to two of the data lines that are not adjacent to each other.

8. The driving apparatus as claimed in claim 7, wherein the data driving units are operational amplifiers.

9. The driving apparatus as claimed in claim 7, further comprising a plurality of switches disposed between the data driving units and the data lines for determining the data lines where output signals of the data driving units to be output to.

10. The driving apparatus as claimed in claim 9, wherein the data driving units and the switches are integrated in at least one driving chip.

11. The driving apparatus as claimed in claim 7, each of the data driving units is electrically coupled to two of the data lines that are alternate with one of the data lines electrically coupled to a neighboring one of the data driving units.

12. A driving apparatus, adapted to drive M*2N pixels on a display panel, wherein M and N are positive integers, and the driving apparatus comprising:

N data driving units; and 2N data lines, each of the data lines being electrically coupled to pixels arranged in a plurality of odd rows of a column adjacent to one side of the each of the data lines and a plurality of even rows of another column adjacent to another side of the each of the data lines, wherein each data line is electrically coupled to only one of the pixels in each of the odd rows and the even rows, wherein each of the data driving units is electrically coupled to two of the data lines that are not adjacent to each other.

13. The driving apparatus as claimed in claim 12, wherein the data driving units are operational amplifiers.

14. The driving apparatus as claimed in claim 12, further comprising a plurality of switches disposed between the data driving units and the data lines for determining the data lines where output signals of the data driving units to be output to.

15. The driving apparatus as claimed in claim 14, wherein the data driving units and the switches are integrated in at least one driving chip.

16. The driving apparatus as claimed in claim 12, each of the data driving units is electrically coupled to two of the data lines that are alternate with one of the data lines electrically coupled to a neighboring one of the data driving units.

* * * * *